US010508482B1

(12) United States Patent
Schaefer

(10) Patent No.: US 10,508,482 B1
(45) Date of Patent: Dec. 17, 2019

(54) DOORSTOP FOR RESTRICTING ENTRY

(71) Applicant: Richard Floyd Schaefer, Fort Lupton, CO (US)

(72) Inventor: Richard Floyd Schaefer, Fort Lupton, CO (US)

( * ) Notice: Subject to any disclaimer, the term of this patent is extended or adjusted under 35 U.S.C. 154(b) by 0 days.

(21) Appl. No.: 16/286,087

(22) Filed: Feb. 26, 2019

(51) Int. Cl.
*E05C 19/00* (2006.01)

(52) U.S. Cl.
CPC ..... *E05C 19/007* (2013.01); *E05Y 2900/132* (2013.01)

(58) Field of Classification Search
CPC ..... E05C 19/007; E05C 19/008; E05C 17/54; E05C 19/00; E05Y 2900/13; E05Y 2900/131; E05Y 2900/132; E05Y 2900/00
USPC ..... 292/199, 342
See application file for complete search history.

(56) References Cited

U.S. PATENT DOCUMENTS 3,583,743 A * 6/1971 Newell ..... E05C 19/004 292/339
4,514,000 A * 4/1985 Chezem ..... E05C 17/443 292/338
5,269,573 A * 12/1993 Rear ..... E05C 17/443 292/199
6,557,209 B1 * 5/2003 Wood ..... E05C 17/443 16/82

* cited by examiner

*Primary Examiner* — Nathan Cumar
(74) *Attorney, Agent, or Firm* — Russell Manning; Marsh Fischmann & Breyfogle LLP

(57) ABSTRACT

Provided herein is a doorstop that may be utilized to prevent opening of a door. Generally, the doorstop is configured for attachment near a bottom edge of a pull side of a door. The doorstop has a deployable wedge or stop element (e.g., stop cylinder) that moves from a suspended position, above a floor surface, to a deployed position in contact with a floor surface. After contacting the floor surface, any attempt to open the door imparts a rotation on the stop element. A radial dimension of the stop element increases along a length of a surface that contact the floor surface. In this regard, rotating the stop element provides an upward lift to the door, which is counteracted by hinges of the door. That is, rotating the stop element results in the door wedging, which prevents opening the door.

17 Claims, 9 Drawing Sheets

DOORSTOP FOR RESTRICTING ENTRY

FIELD

The present disclosure relates generally to a doorstop and, more particularly, to a doorstop that is deployable to prevent opening a door from the outside.

BACKGROUND

Doors are often secured with either a dead bolt and/or a chain from the door to the door frame. Most commonly such locking mechanisms are located on the exterior doors of a structure such as a residential home or building (e.g., office building, school etc.). While deadbolt locks provide significant deterrence to unauthorized entry, these devices are not commonly utilized for interior doors within a structure. Interior doors, if they include a locking mechanism, most commonly utilize a door knob or latch lock. Such door knob locks are most commonly utilized to ensure privacy. However, door knob locks typically fail to provide deterrence to forced entry. Such locks often fail upon one or more blows to the door (e.g., kick, etc.) that often result in dislodging of the door to the extent that the door opens.

Recent concerns relating to locking or securing interior doors include home invasion and/or active shooter situations (e.g., in offices, schools etc.) where an intruder has already entered a structure. In such situations, occupants of such a structure are often encouraged to shelter in-place, for instance, in an interior room having a locking door. By way of example, some schools have recently held drills where students train to barricade classroom doors with furniture and other available items to prevent intruder entry. The effectiveness of sheltering in-place depends on preventing an intruder from accessing a room in which occupants are sheltering.

Based on this background, the present disclosure is directed to a doorstop that may be retrofit to an existing door and deployed by a user and/or automatically to prevent the door from being opened.

SUMMARY

Provided herein is a doorstop that may be utilized to prevent opening of a door (e.g., an interior or exterior door). Generally, the doorstop is configured for attachment near a bottom edge of a door on the pull side of the door. Most commonly, the doorstop is attached to a door near the latch edge of the door. The doorstop has a deployable wedge or stop element (e.g., stop cylinder) that moves from a suspended position above a floor surface to a deployed position in contact with a floor surface. After contacting the floor surface, any attempt to open the door imparts a rotation on the stop element. A radial dimension of the stop element increases along a length of a surface that contact the floor surface. In this regard, rotating the stop element provides an upward lift to the door, which is counteracted by hinges of the door. That is, rotating the stop element results in the door wedging, which prevents its opening.

In an arrangement, the door stop includes a mounting or attachment plate that is configured for attachment to a door surface (e.g., proximate to bottom edge of a door on a pull side of the door). A bracket attaches to the plate and extends away from the plate (e.g., away form a surface of the door). A stop element is rotatably coupled to the bracket such that it rotates about a rotation axis that is substantially parallel to the surface of the door (e.g., substantially parallel to a plane defined by the attachment plate). The stop element includes a contact surface that engages a floor surface when the stop element rotates into a deployed position. The stop element has an increasing radial dimension. For instance, a distance between the rotational axis and a periphery of the contact surface may increase along at least a portion of a length of the contact surface.

The doorstop may further include a latch configured to maintain the stop element in a retracted position and release the stop element to allow deployment of the stop element. In an arrangement, the latch is pivotally attached to the stop element and includes a latch tab configured to engage a detent on an axel connecting the stop element to the bracket. In an arrangement, the latch tab is disposed on a first side of a pivot point pivotally connecting the latch and the stop element. In such an arrangement, an armature may be disposed on an opposing or second side of the pivot point. The armature may be moved (e.g., depressed) to disengage the latch tab from the detent and thereby release the stop element. In an arrangement, the armature portion of the latch has a mass that is greater than a mass of the latch tab portion of the latch. In such an arrangement, the armature portion may form a weighted pendulum. Vibrations or forces applied to the doorstop (e.g., via the door) may impart movement into the weighted pendulum. Such movement may unlatch the latch and deploy the stop element. In such an arrangement, the doorstop may automatically deploy in response to vibrations or forces applied to the door. A spring may be disposed between the latch and the stop element to counteract a weight of the weighted pendulum in the absence of vibrations.

In an arrangement, the doorstop may further include a retractor configured to move the stop element between a first position (e.g., retracted position) and a second position (e.g., deployed position). In one arrangement, the retractor includes teeth that mesh with teeth of a gear connected to the stop element. In one arrangement, linear movement of the retractor imparts a rotation on the stop element. The retractor may also include a spring that is compressed when the stop element is retracted (e.g., when the latch is latched). In such an arrangement, upon unlatching the stop element, the spring may expand to facilitate rotation of the stop element to a deployed position.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

Figure 1A:
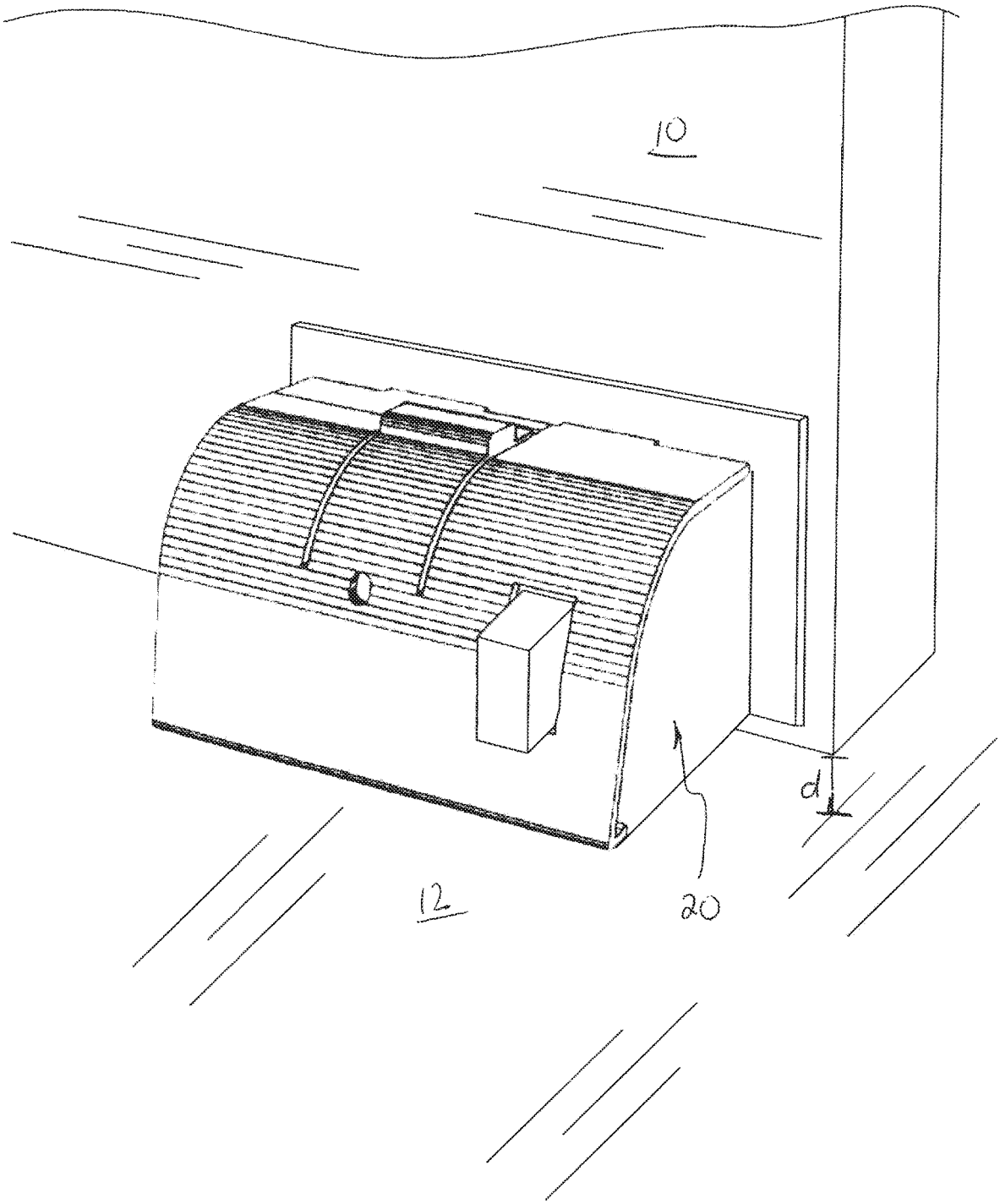
FIG. 1A illustrates a perspective view of a doorstop applied to the bottom edge of a door in an undeployed state.
Figure 1B:
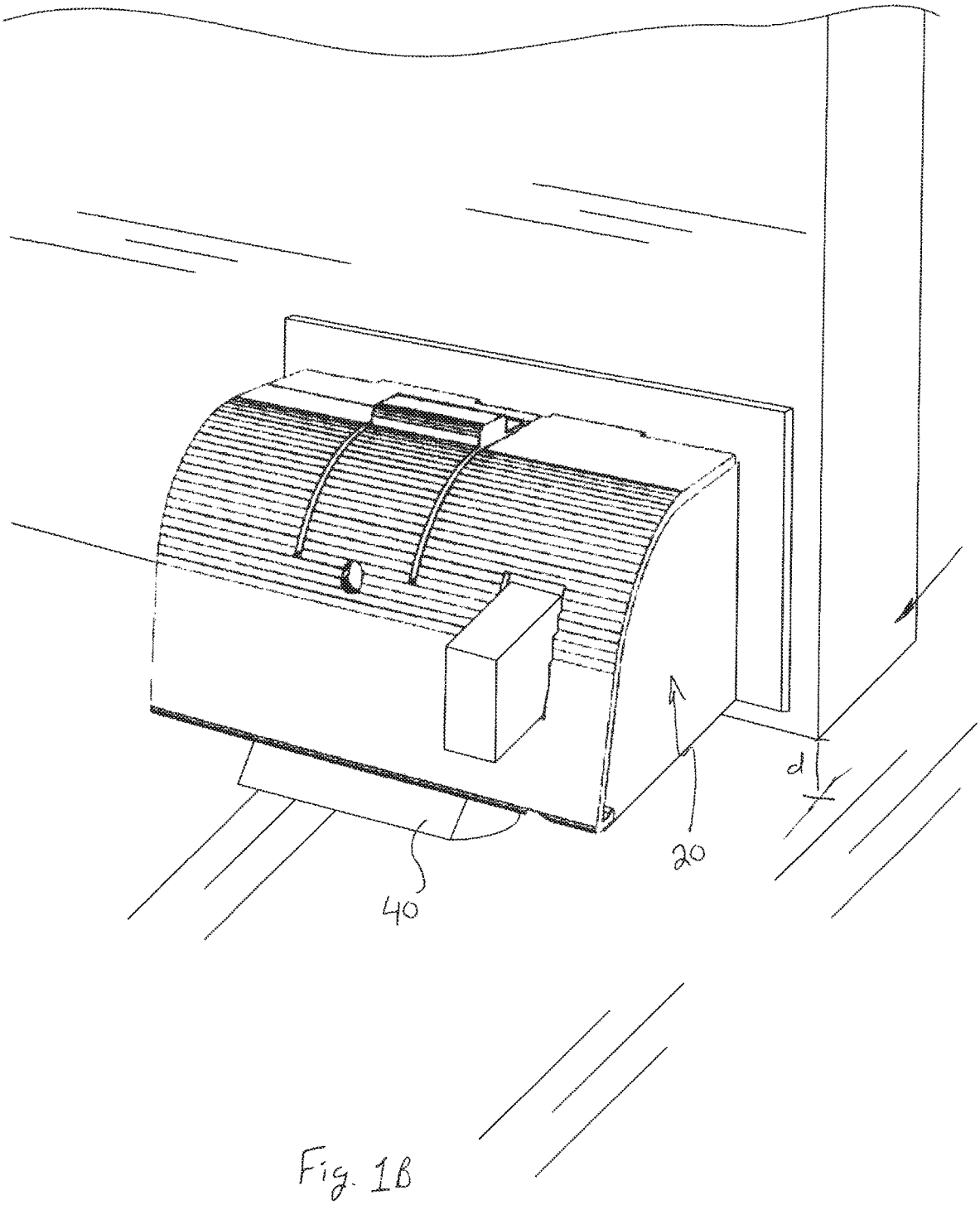
FIG. 1B illustrates a perspective view of the doorstop of FIG. 1A in a deployed orientation to prevent opening of the door.

The present disclosure is directed to a doorstop 20 that is configured for attachment proximate to the bottom and edge of a door 10. See FIGS. 1A and 1B. More specifically, the doorstop 20 is configured for attachment on the pull side of the door 10 typically near the latch edge of the door (e.g., opposite of the hinge edge) such that, when a stopping element 40 of the doorstop 20 engages the floor 12, the doorstop 20 prevents the door 10 from swinging from a closed position to an open position. In this regard, the doorstop 20 may be utilized as a lock (e.g., emergency lock) to prevent entry into, for example, an interior room of a structure (e.g., residence, schoolroom, etc.). Prior to deployment, as shown in FIG. 1A, the doorstop 20 does not interfere with the operation of the door 10 which may swing freely. When deployed, the stop element 40 (hereafter stop cylinder) extends from the bottom surface of the doorstop 22 to engage the floor surface 12, which is a short distance 'd' below the bottom edge of the door 10. To enhance the stopping force of the doorstop, the stop cylinder 40 is rotatably coupled to the doorstop 20 in an offset manner such that a diameter, radius or cross-dimension of a contact surface of the stop cylinder 40 increases as it rotates. More specifically, attempting to push the door open rotates the cylinder 40 in a direction of increasing diameter, which increases the resistance force the doorstop 20 asserts against the door 10, as discussed further herein.

Figure 2A:
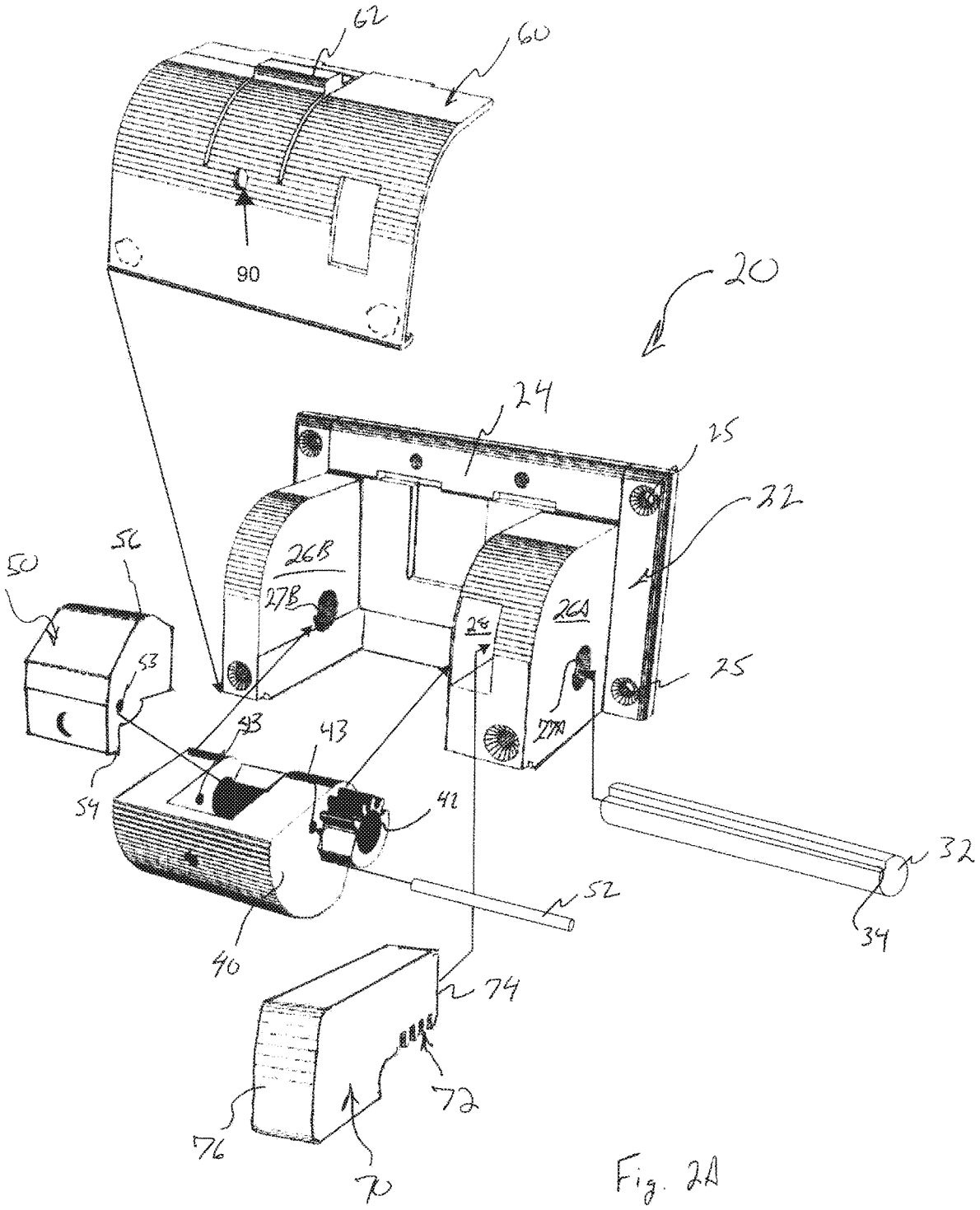
FIG. 2A illustrates an exploded perspective view of the doorstop of FIGS. 1A and 1B.
Figure 2B:
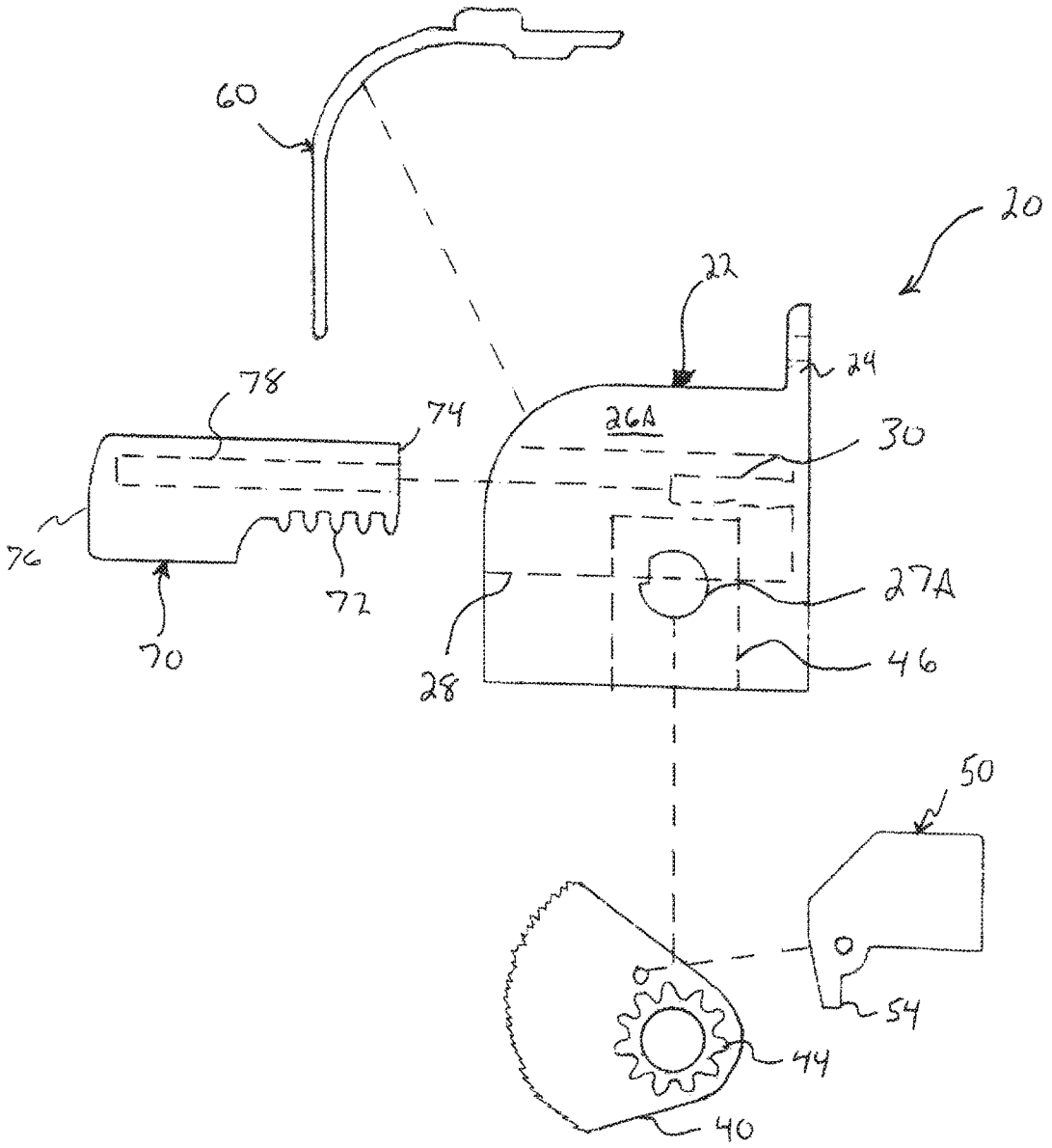
FIG. 2B illustrates an exploded side view of the doorstop of FIGS. 1A and 1B.

FIGS. 2A and 2B illustrates an exploded perspective view and an exploded side view, respectively, of various components of the doorstop 20. As shown, the doorstop 20 includes a housing 22 having a base or mounting plate 24 that is configured for attachment to a door. In an embodiment, the rearward surface of the mounting plate 24 is a generally planar surface configured for juxtaposing on a lower surface of a door. Though described as being generally planar, it will be appreciated that the rearward surface may not be entirely planar may include various contours, which may improve adherence of the mounting plate 24 to a door, when the mounting plate is adhered thereto. In the embodiment illustrated in FIG. 2A, the mounting plate includes a plurality of apertures 25 the may be used to mechanically affix the plate 24 to the surface of a door utilizing, for example, screws. However, it will be appreciated that any means of affixing the plate to a door may be utilized including, without limitation, mechanical fasteners and/or adhesives.

First and second spaced brackets 26A, 26B (hereafter 26 unless specifically referenced) are disposed on the front surface of the mounting plate 24. The brackets 26 extend generally perpendicular and away from a front surface of the mounting plate 24. The brackets 26 define a clevis or yoke extending from the front surface of the mounting plate 24 between which various components of the doorstop 20 are mounted.

When assembled, the stop cylinder 40 is disposed between the first and second brackets 26. More specifically, an axle pin 32 extends through apertures 27A, 27B of the brackets 26A as well as a central aperture 42 extending through the stop cylinder 40. The axle pin 32 rotatably couples the stop cylinder 40 to the housing 22. The stop cylinder 40 is operative to rotate about the axle pin 32 between at least a first angular position and a second angular position. In this regard, the axle pin 32 defines a reference axis of the doorstop 20. Typically, the axle pin 32 is affixed to one or both of the brackets 26 after assembly (e.g., set screw, etc.) to prevent rotation of the axle pin 32. This allows aligning a detent or notch 34 formed along at least a portion of the length of the axle pin 32 in a desired orientation, as further discussed herein. As best shown in FIG. 2B, the aperture 27A of the bracket 26A may be shaped to receive the axle pin and align the notch such that the axle pin is correctly oriented and such that the axle pin cannot rotate.

A latch 50 locks the stop cylinder 40 in a retracted position, when latched, and permits the stop cylinder 40 to deploy to contact a floor surface, when released. In the illustrated embodiment, the latch 50 is pivotal attached to the stop cylinder 40 via a pivot pin 52. In this embodiment, the latch 50 is configured to be disposed within a recess in an upper surface of the stop cylinder 40 between its first and second ends. When assembled, the pivot pin 52 passes through pin apertures 43 in the stop cylinder 40 as well as a pin aperture 53 in the latch 50. The latch 50 includes a tab 54 which is configured to engage the detent or notch 34 formed along the length of the axle pin 32. When the tab 54 engages the notch 34, the stop cylinder 40 is maintained in a nondeployed or retracted position as illustrated in FIG. 1A. In the present embodiment, the latch 50 has an actuator arm 56 on an opposing side of the pin aperture 53 (i.e., on an opposing side of its pivot point). This actuator arm 56 may be depressed (e.g., by a user) to release the tab 54 from the notch 34 and thereby deploy the stop cylinder 40. While the presented embodiment utilizes a latch that engages the axle pin, it will be appreciated that other embodiments may utilize other latching mechanisms.

In the present embodiment, a housing cover 60 is configured to extend between and over the brackets 26. As shown, the cover 60 is contoured to match the top and forward edge contours of the brackets 26 and thereby cover the top and forward surfaces of the doorstop partially enclosing its moving parts. In the present embodiment, the cover 60 further includes a depressible tab 62, which is formed as a living hinge formed by parallel cuts through the housing cover. When the doorstop 20 is assembled, the depressible tab 62 is positioned above/adjacent to the actuator arm 54 of the latch 50. Accordingly, by depressing the tab 62, a user may deploy the stop cylinder 40. The cover may be configured to attach to the housing 22 in a snap fit configuration or may be mechanically affixed (e.g., screwed) to the housing 22.

To retract the stop cylinder 40 once deployed, the doorstop 20 further includes a retractor 70. The retractor 70 is configured for disposition into a correspondingly configured channel 28 extending into the first bracket 26A in a direction substantially perpendicular to the mounting plate 24. In the present embodiment, a rearward portion of the retractor 70 includes a rack 72 (e.g., linear set of teeth). The teeth of the rack 70 engage teeth of a gear 44 attached to or integrally formed with a first end of the stop cylinder 40. When assembled, the gear 44 of the stop cylinder is received in a gear channel 46 (shown in phantom FIG. 2B) extending from the bottom inside surface of the first bracket 26A such that the gear is disposed directly below the rack 72 of the retractor 70. Accordingly, the teeth of the gear 44 mesh with the teeth of the retractor 70. Once the teeth are enmeshed, linear advancement or retraction of the retractor imparts a rotation to the stop cylinder 40.

Figure 6:
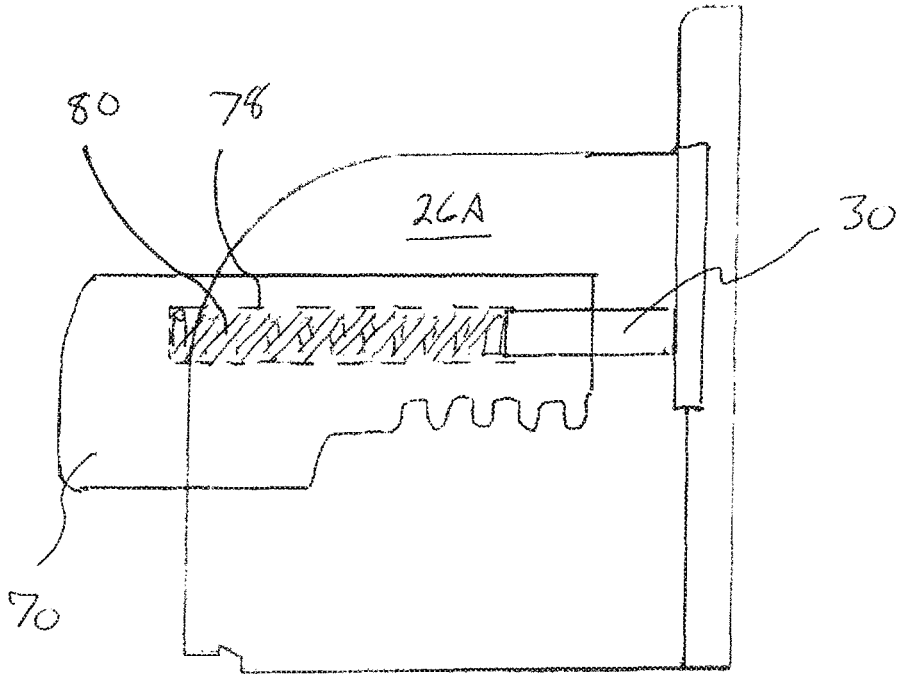
FIG. 6 illustrates the retractor of the doorstop.

An internal channel 78 opening though a rearward end 74 of the retractor 70 extends along a portion of the length of the retractor 70. See FIG. 2B. This channel 78 receives a stud 30 extending from the base or closed end of the retractor channel 28. When assembled, a spring 80 (See, FIG. 6) is disposed in the closed end of the retractor channel 78. This spring 80 is compressed between the closed end of the retractor channel 78 and the stud 30 when the stop cylinder 40 is latched in the retracted position. When the latch 50 releases, the compressed spring expands pushing the retractor 70 outward (i.e., away from the plate 24), which rotates the stop cylinder 40 from the retracted position (e.g., FIG. 1A) to the deployed position (e.g., FIG. 1B) via the enmeshed teeth of the rack 70 and gear 44. To retract the stop cylinder 40, a user pushes on the forward end 76 of the retractor (i.e., toward the plate 24) compressing the spring 80 and rotating the stop cylinder 40 to the retracted position via the enmeshed teeth of the rack 70 and gear 44. When the stop cylinder 40 is retracted, the latch 50 engages the notch 34 in the axle pin 32.

Figure 3A:
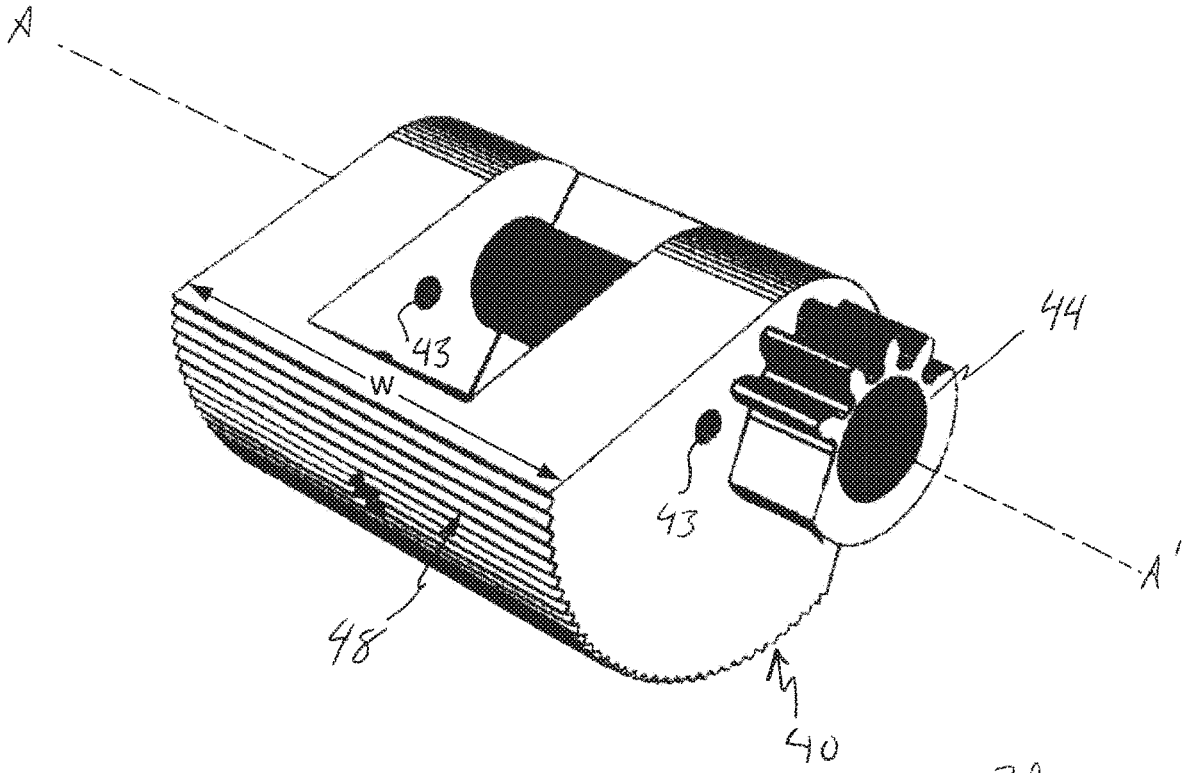
FIG. 3A illustrates a perspective view of a stop cylinder of the doorstop.
Figure 3B:
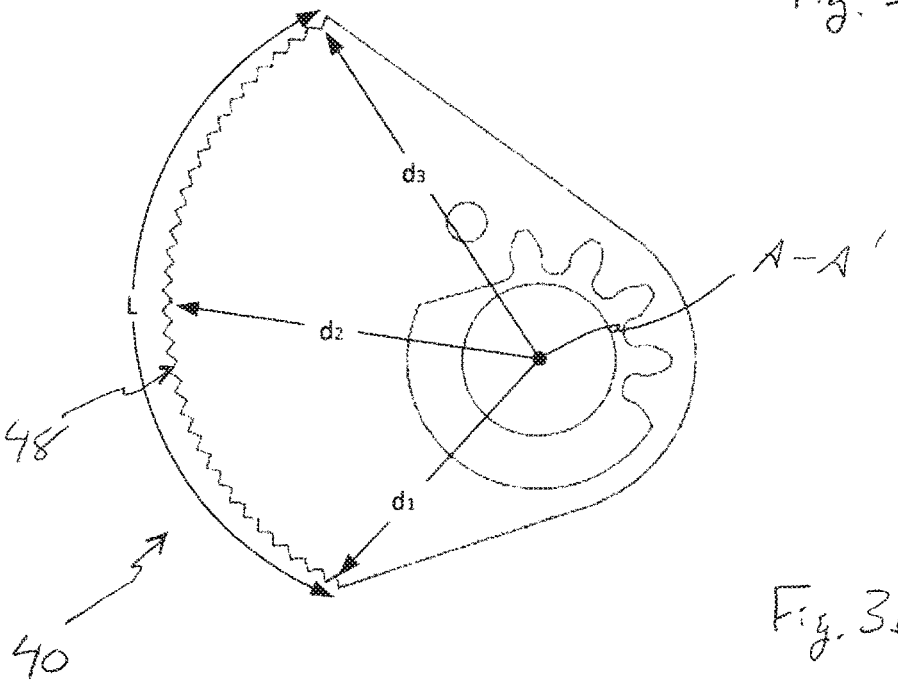
FIG. 3B illustrates an end view of the stop cylinder.

FIGS. 3A and 3B illustrate a perspective view and a side view, respectively, of the stop cylinder 40. Though discussed as a cylinder, the stop cylinder 40 is not necessarily a cylindrical element. Rather, the stop cylinder is a rotating wedge that is configured to increase a cross-dimension when rotating in contact with a floor surface. In the illustrated embodiment, the stop cylinder 40 includes an arcuate contact surface 48 that is configured to engage a floor surface when the stop cylinder 40 rotates about its rotational axis A-A', which is generally aligned with a central axis of the axle pin when assembled. As illustrated, the width dimension W of the arcuate surface 48 is substantially parallel to the rotational axis of the stop cylinder 40. In contrast, the distance between the contact surface 48 and the rotational axis A-A' increases over the length dimension L of the contact surface 48. As best shown in FIG. 3B, which illustrates the peripheral edge of the arcuate surface 48, a radial dimension 'd' generally increases over the length L of the arcuate surface 48. As is further discussed and shown in FIGS. 4A-4D herein, the stop cylinder 40 initially rotates into contact with the floor surface at a location of a smaller radial dimension (e.g., near $d_1$). Continued rotation of the stop cylinder (e.g., counterclockwise as shown in FIG. 3B) results in a greater radial dimension (e.g., $d_2$ and then $d_3$) of the stop cylinder 40 being forced into contact with an underlying floor surface.

The increase in the radial dimension of the contact surface can take any appropriate shape. For instance, the contact surface may be formed from a segment of an eccentric cylinder having a center offset from the rotational axis A-A'. Alternatively, the contact surface may be formed as a cam lobe, a parabolic surface, a singly curved surface, etc. In the latter regard, the contact surface may a surface that can be flattened onto a plane without distortion such that the width dimension of the surface remains parallel to the rotational axis over its length. What is important, is that the radial dimension of the contact surface increase over at least a portion of the contact surface. Of note, the increase in the radial dimension does not have to increase linearly or uniformly over its length. For instance, the surface may be stair stepped. Further, the radial dimensions may be selected based on the anticipated use of the doorstop. For instance, when utilized with pliable floor surfaces (e.g., carpeted surfaces), the radial dimension may be increased to provide improved contact with the pliable surface.

In the illustrated embodiment, the contact surface 48 is illustrated as a serrated surface. The serrations provide good gripping for many surfaces (e.g., tile, linoleum, carpets, etc.). However, it will be appreciated that other surface finishes are possible. For instance, the contact surface may further include a rubberized layer or coating applied thereto. Further, the contact surface may include projections (e.g., teeth) for use with deep pile carpeting. Likewise, the stop cylinder may be formed of any appropriate material (e.g., hard rubber, plastic, metal etc.).

Figures 4A, 4B, 4C, 4D:
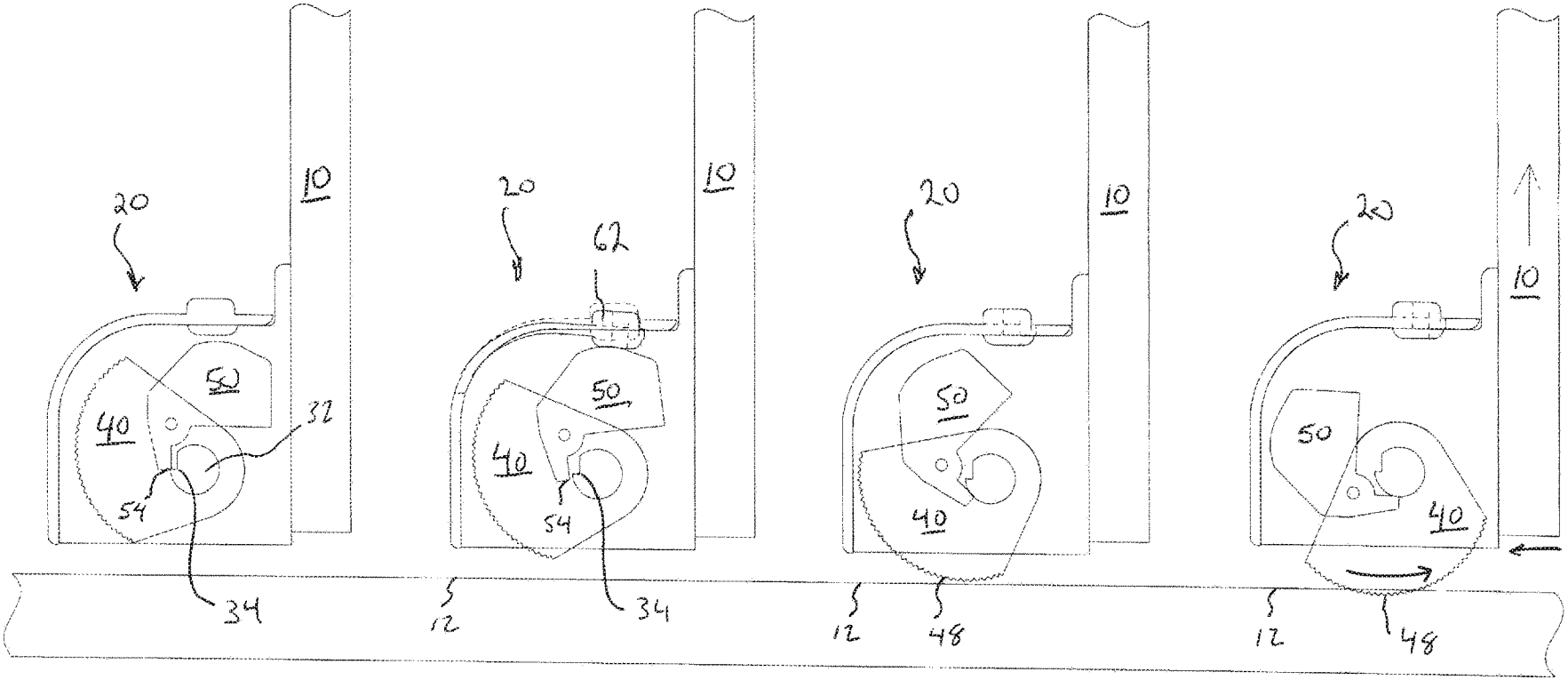
FIGS. 4A-4D illustrate side views of the operation of the doorstop of FIGS. 1A-2B.

FIGS. 4A-4D illustrate partial side views of the doorstop 20 attached to a door 10. More specifically, these figures illustrate the progression of the deployment of the stop cylinder 40. As shown in FIG. 4A, the doorstop 20 is attached proximate to the lower edge of the door 10 in a retracted position (e.g., a first position). When in the retracted position, the tab 54 of the latch 50 may engage the notch 34 of the axle pin 32. In this orientation, the latch 50 locks the stop cylinder 40 in the retracted position such that the stop cylinder 40 is suspended near the bottom edge of the bracket/housing. As shown in FIG. 4B, a user may depress the tab 62 on housing cover to engage the latch 50. This moves the latch tab 54 from the notch 34 of the axle pin 32 allowing the stop cylinder 40 to rotate until the contact surface 48 contacts the floor surface 12. See FIG. 4C. That is, the stop cylinder 40 deploys below the bottom edge of the bracket/housing (e.g., to a second position). Once the contact surface 48 contacts the floor surface 12, any attempt to open of the door 10, as shown by the arrow pointing left in FIG. 4D, rotates the stop cylinder 40 in the direction of increasing radial dimension. This results in an upward force being applied to the door as shown by the arrow within the door edge. This upward force is counteracted by the hinges (not shown) of the door resulting in a wedging of the door. That is, the rotation of the stop cylinder 40 against the increasing radial dimension provides a locking mechanism the prevents opening of the door 10.

Figures 5A, 5B, 5C, 5D:
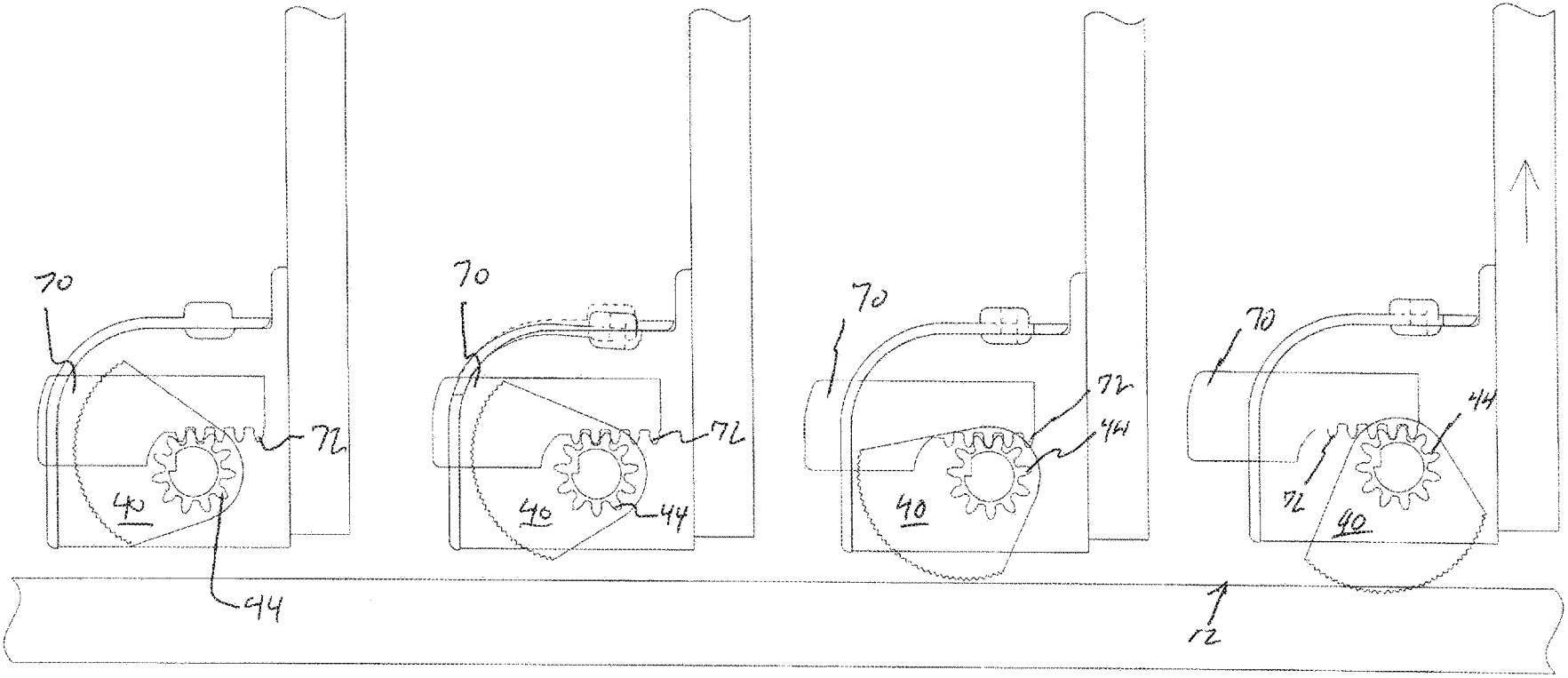
FIGS. 5A-5D illustrate side views of the operation of a retractor of the doorstop of FIGS. 1A-2B.

FIGS. 5A-5D illustrate partial side views of the doorstop 20 to show the interaction of the retractor 70 with the gear 44 of the stop cylinder 40. As shown in all these figures, the teeth of the rack 72 are enmeshed with the teeth of the gear 44 attached to the stop cylinder 40. Initially, as shown in FIG. 5A, the retractor 70 is disposed towards the rearward end of the retractor channel while the stop cylinder 40 is in the retracted and locked position. Upon release of the latch (e.g., see FIG. 4B), the retractor 70 begins to move outward (i.e., leftward as illustrated) in conjunction with the rotation of the stop cylinder 40 as shown in FIGS. 5B-5D. When the stop cylinder 40 is fully engaged with the floor surface 12 as shown in FIG. 5D, a user may push on the end of the retractor 70 (i.e., to the right as illustrated) which results in the rotation of the stop cylinder 40 from the floor surface 12 (e.g., FIG. 5C then 5B) until the stop cylinder 40 is again disposed in the retracted and locked position shown in FIG. 5A.

Figure 7:
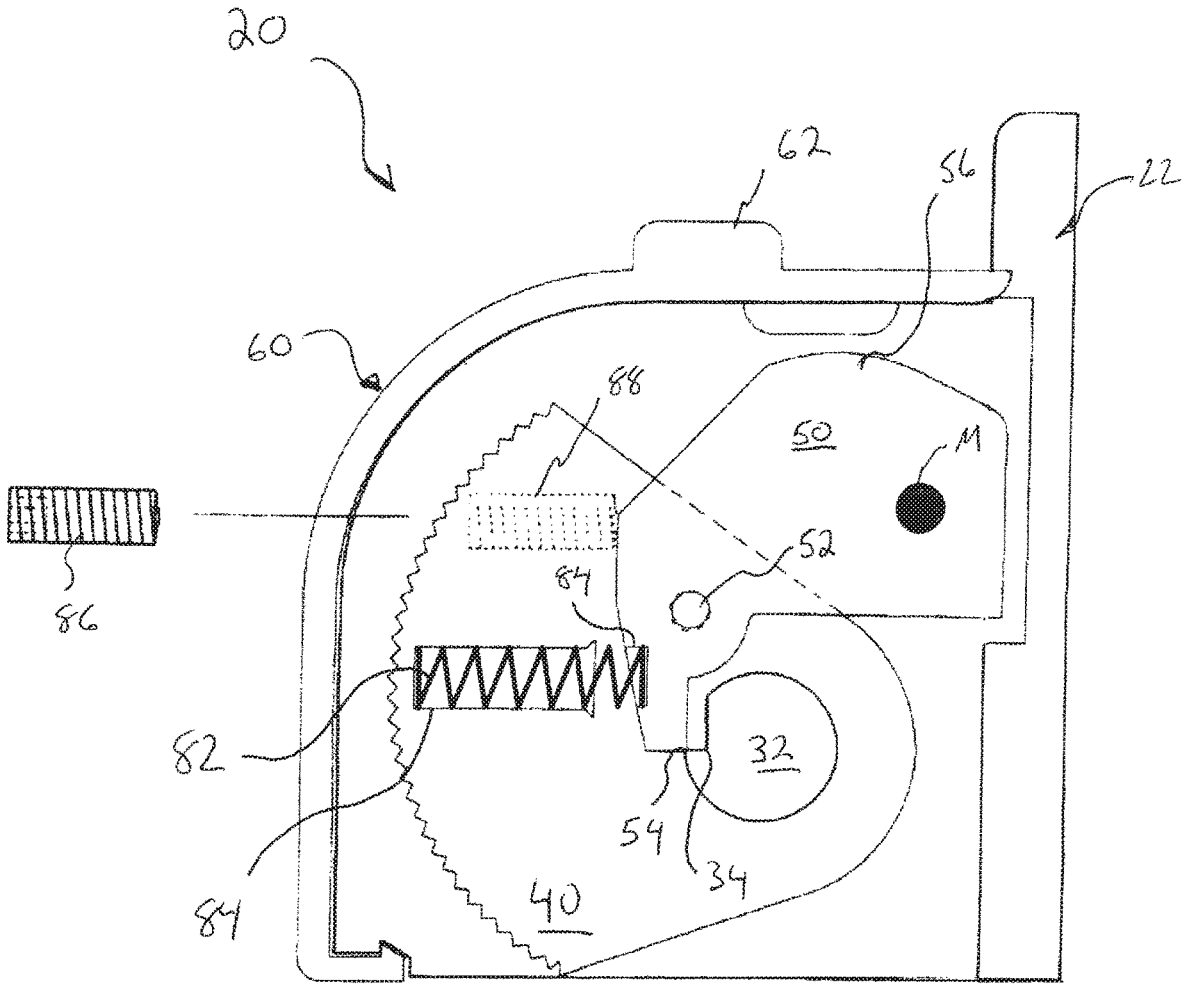
FIG. 7 illustrates the pendulum latch of the doorstop.

FIG. 7 illustrates additional features that may be incorporated into the doorstop 20. In an embodiment, the latch 50 may form a weighted pendulum that allows for automatically deploying the stop cylinder 40, upon the doorstop 20 being jarred. Stated otherwise, a force or vibration applied to a door to which the doorstop 20 is attached may disengage the latch tab 54 from notch 34 of the axle pin 32 to permit the stop cylinder 40 to automatically deploy. As shown, the armature portion 56 of the latch 50, which is disposed above the pivot pin 52 (e.g., pivot point), may have a greater size and mass than the latch tab portion 54 disposed below the pivot pin 52. Accordingly, vibration applied to the doorstop 20 may impart movement in the higher mass armature portion 56. This movement may disengage the latch tab 54 from the notch 34 of the axle pin 32 releasing the stop cylinder 40. In an embodiment, an additional mass M or weight may be inserted into the armature portion 56 of the latch 50. Higher masses may permit dislodging the latch tab in response to lower vibrations.

To counter act the higher mass of the armature portion 56, a spring 82 may be disposed between the latch 50 and the stop cylinder 40. In the present embodiment, the spring 82 is disposed in an internal channel 84 that extends into the stop cylinder 40 and/or and internal channel 84 that extends into the latch 50. As shown, the spring 80 may be positioned below the pivot point defined by the pivot pin 52. However, the spring 82 may be positioned anywhere where it may apply a force to counteract the mass of the armature portion of the latch. Further, the size and compressive/expansive force applied by the spring may be selected to provide a desired level of automated deployment.

In an embodiment, a set screw 86 may be incorporated into the stop cylinder 40 of the latch 50 to adjust the depth that the latch tab 54 engages within the notch 34 of the axle pin 32. In the illustrated embodiment, the set screw 86 is received in a threaded aperture 88 that extends through a portion of the stop cylinder 40. When the set screw 86 is disposed within the threaded aperture 88, a forward end (e.g., right end as illustrated) may extend through the bottom end of the threaded aperture 88 and abut the latch 50. Continued advancement of the set screw rotates the latch 50 about the pivot pin 52 and relative to the stop cylinder 40. In the embodiment illustrated in FIG. 7, this imparts a clockwise rotation to the latch 50. The abutment of the forward end of the set screw 86 against the latch (e.g., above the pivot point) compresses the spring 82 disposed below the pivot point. This also adjusts the position of the latch tab 54 within the notch 34 of the axle pin 32. Specifically, additional advancement of the set screw 86 retracts the latch tab 54 relative to the notch 34. Accordingly, adjustment of the set screw allows for adjusting the responsiveness of the pendulum latch 50 to vibrations. When the latch tab 34 is barely disposed within the notch 34, light vibrations or forces applied to the door result in the disengagement of the latch 50 and the automatic deployment of the stop cylinder 40. In contrast, when the set screw 86 is adjusted to permit disposition more of the latch tab 54 within the notch 34 (i.e., set screw more retracted; latch tab deeper in the notch), greater vibrations/forces are required to dislodge the latch 50. Accordingly, a user may adjust the set screw at a desired depth to adjust the sensitivity of the doorstop for automated deployment. In an embodiment, the set screw has a recessed hex head allowing a user to adjust the set screw using an Allen wrench, which may extend through an aperture 90 in the housing cover 60. See FIG. 2A.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. A doorstop, comprising:
a housing having:
an attachment plate with a rearward surface configured for attachment proximate to a bottom edge of a pull side of a door; and
a bracket attached to the attachment plate and extending away from a forward surface of the attachment plate;
a stop cylinder rotatably coupled to the bracket about a rotational axis that is substantially parallel to a plane defined by the attachment plate, the stop cylinder including an arcuate contact surface, wherein a distance between a periphery of the arcuate contact surface and the rotational axis increases over at least a portion of the length of the arcuate contact surface;
a latch configured to move relative to a pivot point between a latched position and an unlatched position to affix the stop cylinder and release the stop cylinder, respectively, wherein the latch is pivotally attached to the stop cylinder about the pivot point; and
wherein the stop cylinder is configured to rotate between a first position where the arcuate contact surface is retracted relative to a lower edge of the doorstop and a second position where the arcuate contact surface deploys below the lower edge of the doorstop to contact a floor surface.

2. The doorstop of claim 1, wherein the latch further comprises:
a tab disposed on a first side of the pivot point configured to engage a detent formed in an axle rotatably coupling the stop cylinder to the bracket, and
an armature disposed on a second side of the pivot point, wherein moving the armature moves the tab relative to the detent.

3. The doorstop of claim 2, wherein the armature defines a weighted pendulum when the doorstop is attached to the door.

4. The doorstop of claim 3, further comprising:
a spring disposed between the stop cylinder and the latch, wherein the spring at least partially counteracts the weighted pendulum when the tab is disposed in the detent.

5. The doorstop of claim 1, further comprising:
a retractor movably attached to the stop cylinder, wherein movement of the retractor moves the stop cylinder between the first position and the second position.

6. The doorstop of claim 5, wherein the retractor further comprises:
teeth that engage teeth of a gear attached to the stop cylinder.

7. The doorstop of claim 6, wherein the gear is disposed about at least a portion of the rotational axis.

8. The doorstop of claim 6, wherein the teeth of the retractor comprise a linear rack.

9. The doorstop of claim 6, further comprising:
a spring disposed between the retractor and the housing, wherein the spring is compressed when the stop cylinder is in the first position.

10. The doorstop of claim 1, wherein the contact surface comprises:
a surface having a width dimension that is substantially parallel to the rotational axis over a length of the surface.

11. The doorstop of claim 1, wherein the bracket comprises first and second spaced brackets, wherein the stop cylinder is disposed between the spaced brackets and an axle extends through the spaced bracket and the stop cylinder disposed there between.

12. A doorstop, comprising:

a housing having:

an attachment plate with a rearward surface configured for attachment proximate to a bottom edge of a pull side of a door; and a bracket attached to the attachment plate and extending away from a forward surface of the attachment plate;

a wedge rotatably coupled to the bracket about a rotational axis that is substantially parallel to a plane defined by the attachment plate, wherein the wedge is configured to rotate between a first position where a contact surface of the wedge is suspended relative to a bottom edge of the doorstop and a second position where the contact surface deploys below the lower edge of the doorstop to contact a floor surface; and a pendulum latch movable about a pivot point, the pendulum latch having:

a first end portion disposed on a first side of the pivot point configured to engage the wedge to maintain the wedge in the first position; and a second end portion is disposed on a second side of the pivot point, the second end portion having a mass that is greater than the mass of the first end portion.

13. The doorstop of claim 12, wherein the contact surface comprises an arcuate contact surface, wherein a distance between a periphery of the arcuate contact surface and the rotational axis increases over at least a portion of the length of the arcuate contact surface.

14. The doorstop of claim 12, wherein the pendulum latch is pivotally connected to the wedge about the pivot point.

15. A doorstop, comprising:

a housing having:

an attachment plate with a rearward surface configured for attachment proximate to a bottom edge of a pull side of a door; and a bracket attached to the attachment plate and extending away from a forward surface of the attachment plate;

a stop cylinder rotatably coupled to the bracket about a rotational axis that is substantially parallel to a plane defined by the attachment plate, the stop cylinder including an arcuate contact surface, wherein a distance between a periphery of the arcuate contact surface and the rotational axis increases over at least a portion of the length of the arcuate contact surface;

a retractor movably attached to the stop cylinder, the retractor having teeth that engage teeth of a gear attached to the stop cylinder, wherein movement of the retractor moves the stop cylinder between the first position and the second position;

a spring disposed between the retractor and the housing, wherein the spring is compressed when the stop cylinder is in a first position; and wherein the stop cylinder is configured to rotate between the first position where the arcuate contact surface is retracted relative to a lower edge of the doorstop and a second position where the arcuate contact surface deploys below the lower edge of the doorstop to contact a floor surface.

16. The doorstop of claim 15, wherein the gear is disposed about at least a portion of the rotational axis.

17. The doorstop of claim 15, wherein the teeth of the retractor comprise a linear rack.

* * * * *